United States Patent [19]

Kitamura

[11] Patent Number: 5,074,181

[45] Date of Patent: Dec. 24, 1991

[54] WAVEFORM DATA LOOPING SYSTEM

[75] Inventor: Mineo Kitamura, Shizuoka, Japan

[73] Assignee: Kabushiki Kaisha Kawaigakki Seisakusho, Shizuoka, Japan

[21] Appl. No.: 388,428

[22] Filed: Aug. 2, 1989

[30] Foreign Application Priority Data

Aug. 11, 1988 [JP] Japan ..... 63-200988
Nov. 4, 1988 [JP] Japan ..... 63-279028

[51] Int. Cl.[5] ..... G10H 7/02

[52] U.S. Cl. ..... 84/607; 84/627; 84/622; 84/659; 307/529

[58] Field of Search ..... 84/603-608, 84/622-625, 627, 659; 307/353, 529, 498; 328/178, 187, 160; 381/51

[56] References Cited

U.S. PATENT DOCUMENTS 4,435,831 3/1984 Mozer ..... 84/622 X
4,520,708 6/1985 Wachi ..... 84/627 X

*Primary Examiner*—William M. Shoop, Jr.
*Assistant Examiner*—Brian Sircus
*Attorney, Agent, or Firm*—Sughrue, Mion, Zinn, Macpeak & Seas

[57] ABSTRACT

A waveform data looping system has waveform data sampled for a predetermined time period and stored in a first memory. Data read-out is started at a looping start point in the time period and, after a readout at an end point is completed, the readout is again started at the starting point, repeatedly. The system includes a processing device for dividing the data stored in the first memory into two sections at an intermedial point of the predetermined time period, multiplying the data in the preceding section such that a data value at the start point is 0% and that at the intermedial point is 100% and that between the start and the intermedial points varies between 0% and 100% and the data in the subsequent section such that the data at the intermedial is 100% and that at the end point is 0% and that between the intermedial and end points varies between 100% and 0%, and adding the multiplied preceding data section and the multiplied subsequent data section. A second memory stores an output of the processing device, and a reproducing devices reads and reproduces the data stored in the second memory from the start point to the intermedial point repeatedly.

12 Claims, 6 Drawing Sheets

WAVEFORM DATA LOOPING SYSTEM

BACKGROUND OF THE INVENTION

The present invention relates to a waveform data looping system for use in an electronic musical instrument to obtain a smooth change of waveform.

While playing an electronic musical instrument such as an electronic piano, there may be a demand for repeatedly listening to a portion of varying sound. In such a case, it has been routine to magnetically record that sound portion, to sample a waveform of the sound at a predetermined sampling time interval from an initial time to an end time of the sound portion, A/D convert the sampled values and to store them in a memory device as digital signals. Then, the stored signals are read out, D/A converted and reproduced, sequentially, and this operation is repeated. This repeated reproduction of such a portion of sound is referred to as "looping".

In the looping operation, the reproducing operation is returned from the end point of the sound to the start point repeatedly. In such a case, since the data value at the start point has no relation to that at the end point, there may be noise produced at a start of a new reproduction cycle. Further, since a tendency of change of a data value in a time period up to the end time point differs from that immediately after a new cycle starts, there may be discontinuity in volume and tone at such a change point of the reproduction cycle, which makes a listener uncomfortable.

SUMMARY OF THE INVENTION

An object of the present invention is to provide a waveform data looping system in which data values at a commencement and an end of a "loop" are made equal and data value between the commencement and the end of the loop are processed to have intermedial values so that there is no discontinuity of the data value at a repeating point of the looping, resulting in a smooth looping operation.

According to the present invention, a waveform data looping system in which waveform data sampled for a predetermined time period are stored in a first memory, the data read out is started at a looping start point in the time period and, after a read out at an end point is completed, the read out is again started at the starting point, repeatedly, comprises processing means for dividing the data stored in the first memory into two sections at an intermedial point of the predetermined time period, multiplying the data in the processing section such that a data value at the start point is 0% and that at the intermedial point is 100% and that between the start and the intermedial points varies between 0% and 100% and the data in the subsequent section such that the data at the intermedial is 100% and that at the end point is 0% and that between the intermedial and end points varies between 100% and 0%, and adding the multiplied preceding data section and the multiplied subsequent data section, a second memory for storing an output of the processing means and reproducing means for reading and reproducing the data stored in the second memory from the start point to the intermedial point repeatedly.

Hence, the sampled data stored in the first memory is multiplied at every sampling point in such a way that the data at the intermedial point is multiplied with 100% , the data at the start and the end points are multiplied with 0% and the data sampled at other points than the mentioned time points are multiplied so that they have intermedial values in between 0% and 100%. The multiplied data in the first half period and those in the second half period are added and stored in the second memory. The looping is performed by reproducing such data from the start point to the intermedial point, repeatedly.

BRIEF DESCRIPTION OF THE DRAWINGS

FIGS. 4A-4F and 5A-5F show analog waveforms for explanations of other embodiments of the present invention;

DETAILED DESCRIPTION OF THE PREFERRED EMBODIMENTS

Figure 1A:
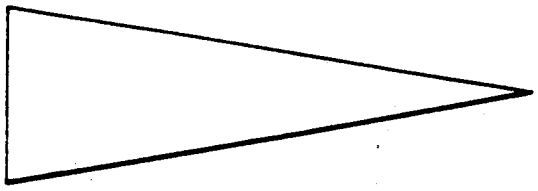
FIG. 1A-1F shows an analog waveform for explanatory purposes of an operation of an embodiment of the present invention.
Figure 1B:
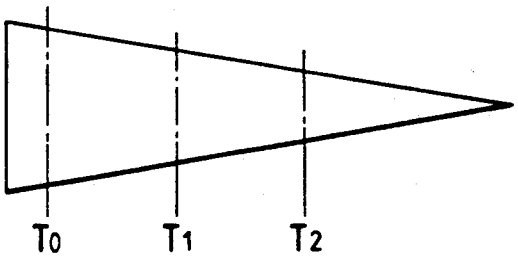
Figure 1C:
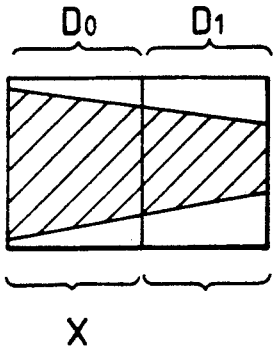

FIGS. 1A to 1F show steps of an original signal waveform processing, according to the present invention. For the original signal waveform shown in FIG. 1A, a looping start time T0, an intermedial point T1 and an end point T2 are set as shown in FIG. 1B. Data D0 in a first half period from the start point T0 to the intermedial point T1 and data D1 in a second half period from the intermedial point T1 to the end point T2 shown in FIG. 1C are stored in a first memory. Although the waveforms in these figures are shown in analog format, the data D0 and D1 are obtained by sampling the original signal with a clock signal having a very short repetition period and, therefore, the envelope of the data signal shown in FIG. 1C should be considered as lines connecting peak values of the sampled data.

Figure 1D:
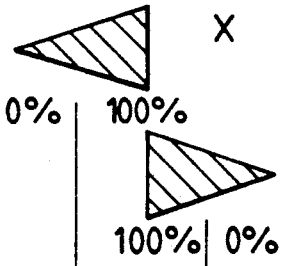

FIG. 1D illustrates variations of multiplying coefficients to be used for these data D0 and D1. As shown, the multiplying coefficients for the data value D0 at the start point T0 and the intermedial point T1 are 0% and 100% respectively, and it increases monotonically between them. For the data D1, the multiplying coefficients at the intermedial point and the end point are 100% and 0%, respectively, and it decreases monotonically.

Figure 1E:
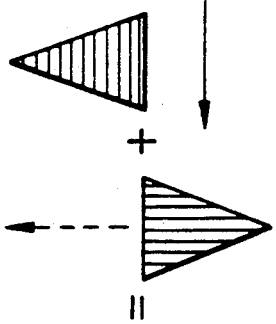

FIG. 1E shows a result of multiplication of the data D0 and D1 with the coefficients shown in FIG. 1D.

Figure 1F:
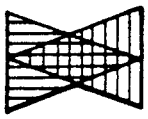

The results shown in FIG. 1E are added to each other, resulting in a waveform shown in FIG. 1F. The waveform in FIG. 1F is reproduced repeatedly.

Although, in FIG. 1D, the multiplying coefficient varies linearly with time, it may be not always linear and the variation may be along any smooth curve so long as the data values at the 0% and the 100% points are equal.

Figure 2:
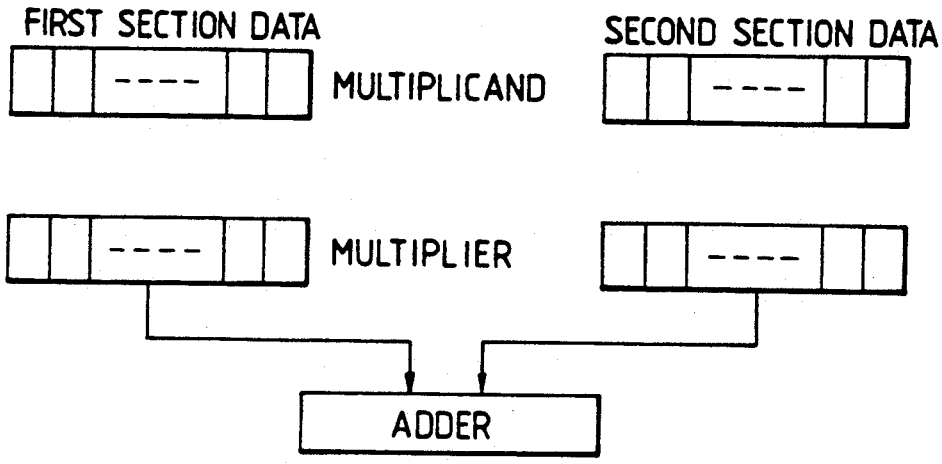
FIG. 2 is an illustration showing the operation in FIG. 1A-1F.

FIG. 2 shows a multiplication and addition operation for obtaining the data shown in FIG. 1E. In FIG. 2, the multiplication data (0% to 100%) are assigned to the data (D0, D1), respectively, and the multiplication is performed for the first half data D0 and the second half data D1. Then, the first half data D0 and the second half data D1 are added together by an adder.

Figure 3:
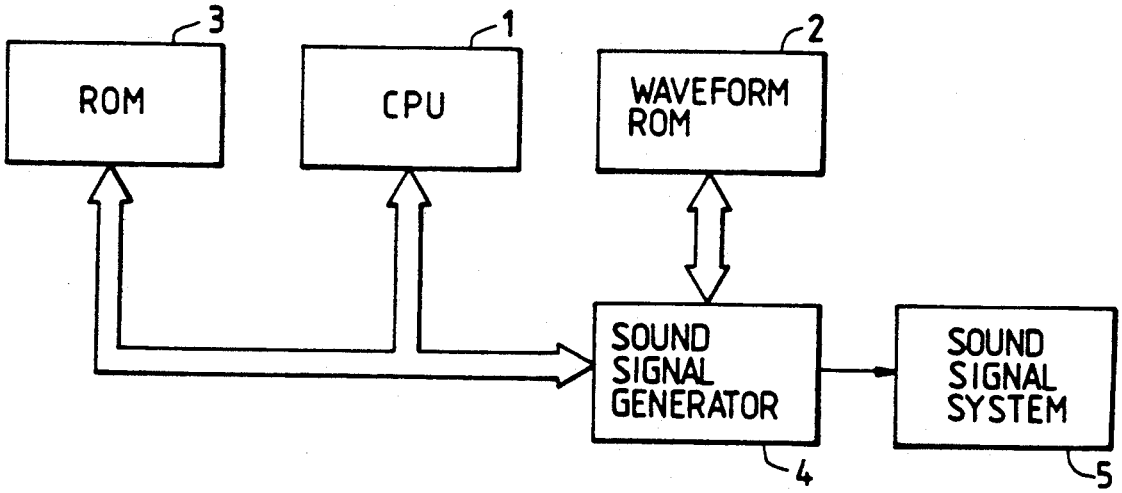
FIG. 3 is a block circuit diagram for performing the operation of the present embodiment.

FIG. 3 is a block circuit diagram of hardware for obtaining a reproduction signal for the digital data obtained according to the scheme shown in FIGS. 1 and 2.

In FIG. 3, the data values are stored in a waveform ROM 2. An ROM 3 stores a start address and an end address of the waveform ROM 2 for a loop read out of the data therein. The data read out from the ROM 3 is looped by sending it by a central processing unit (CPU) 1 to a sound signal generator 4 and accessing the waveform ROM 2. The read out data may be digital-to-analog converted and sent to a sound signal system 5, if necessary.

Figure 4A:
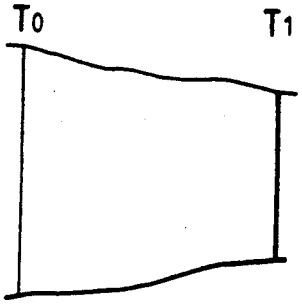
Figure 4B:
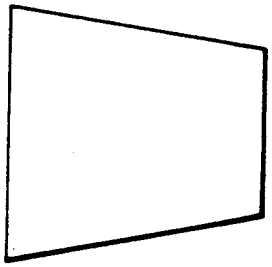
Figure 4C:
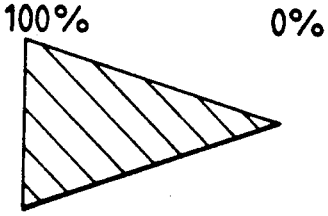

FIGS. 4A to 4F show waveforms similar to those shown in FIGS. 1A to 1F, for explanation of another embodiment of the present invention. In FIG. 4A, an original signal waveform is shown with a looping start point T0 and a looping end point T1 and FIG. 4B shows data between the points T0 and T1. For the data shown in FIG. 4B, a multiplication is performed with multiplication coefficients starting at 100% at the starting point T0 and ending at 0% at the ending point T1, as shown in FIG. 4C. The coefficient is monotonically decreased therebetween, resulting in the data shown in FIG. 4D.

Figure 4D:
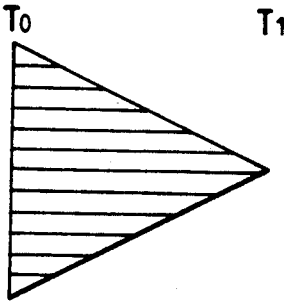

The data shown in FIG. 4D is stored in a first memory (not shown).

Figure 4E:
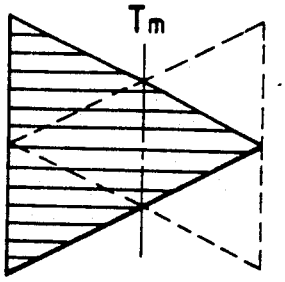

The waveform data shown in FIG. 4D is read out in opposite directions and, as shown in FIG. 4E, the waveform data read out in the reverse direction, which is shown by a dotted line, is overlapped on the waveform data read out in the normal direction so as to have an intermedial or change point TM.

Figure 4F:
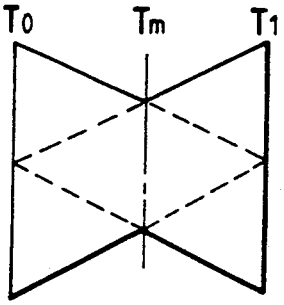

The resultant waveform data shown in FIG. 4F is stored in the second memory. Thus, it is possible to execute a waveform data loop starting at T0 and ending at T1.

Figure 5A:
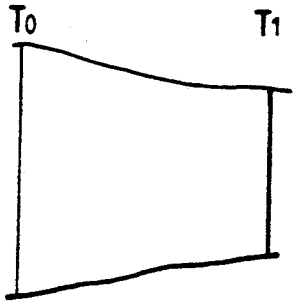
Figure 5E:
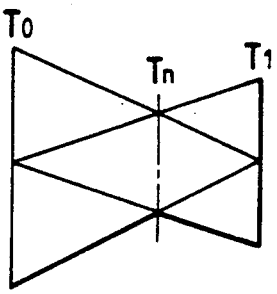
Figure 5B:
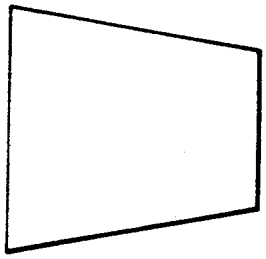
Figure 5F:
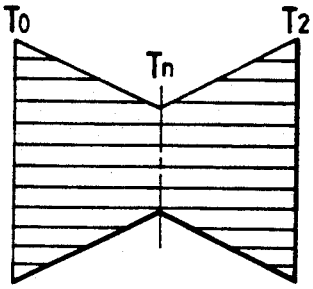
Figure 5F:
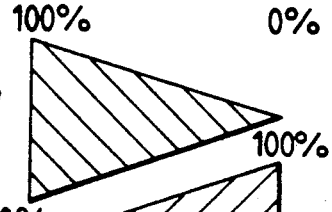
Figure 5F:
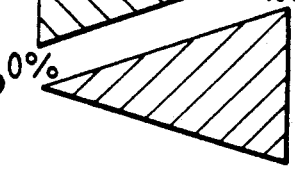
Figure 5F:
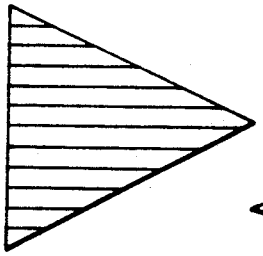
Figure 5F:
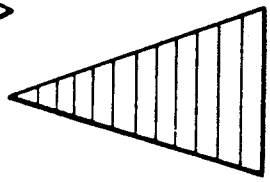

FIGS. 5A to 5F show a waveform processing according to another embodiment of the present invention. Waveform data shown in FIG. 5B corresponds to a portion of an original waveform shown in FIG. 5A defined by a start time T0 and an end time T1, which is stored in a location of a first memory. The waveform data stored in the first memory is read out and multiplied with coefficients shown in FIGS. 5C1 and 5C2, respectively, resulting in waveform data shown in FIGS. 5D1 and 5D2. The waveforms waveform data shown in FIGS. 5D1 and 5D2 are stored in other locations of the first memory.

The data in FIG. 5D1 is read out in the normal direction until a time instance Tn at which time the data value thereof becomes the same magnitude as that of the waveform data in FIG. 5D2. Then waveform data corresponding to FIG. 5D1 is read out in the reverse direction, resulting in a waveform data shown in FIG. 5F, which is stored in a second memory. By reading this data from T0 to T2, a smooth looping is achieved since there is no amplitude difference between the data at the time instances T0 and T2.

Figure 6:
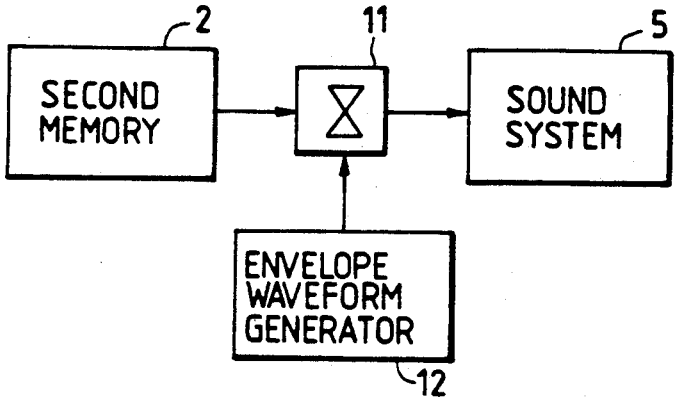
FIGS. 6 and 7 show examples of an external instruction and control means for instructing and controlling a read out timing of a second memory, respectively.

FIG. 6 is a block diagram showing a circuit construction for performing an envelope processing to loop the data read out from the second memory. In FIG. 6, a waveform memory 2 serves as the second memory for storing the waveform data shown in FIG. 1F, 4F or 5F. The data read out from the waveform memory 2 is multiplied or modulated in a multiplier 11 with envelope waveform data from an envelope waveform data generator 12 and the modulated waveform data is sent to a sound system 5 for reproduction.

Figure 7:
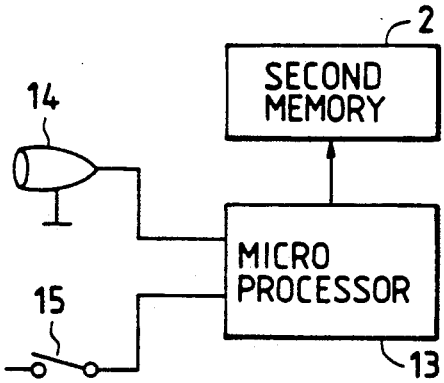

FIG. 7 shows another embodiment which makes an instruction or control of the readout starting and the readout ending of the second memory 2 possible. In FIG. 7, a microprocessor 13 is further provided as a control means for the second memory 2. The microprocessor 13 decodes an instruction in the form of a sound signal from a microphone 14 or a switch-on signal from a push button 15, which continues for a predetermined time period, to control the start and termination of read out of the stored data in the second memory.

Figure 8:
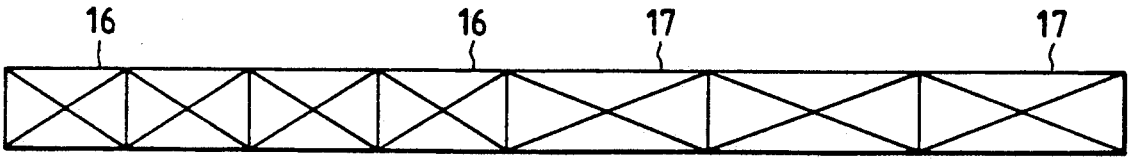
FIG. 8 illustrates a repetitive reproduction of each of the different data.

FIG. 8 illustrates a reproduction of different waveforms by different times. In FIG. 8, a relatively short time looping waveform 16 is reproduced four times and a relatively long time looping waveform 17 is reproduced three times.

When a number of looping waveforms are prepared in addition to the waveforms 16 and 17, a sequence of reading thereof may be set arbitrarily or at random, besides the reading sequence of the waveforms 16 and 17. Further, the number of loopings of each of the waveforms 16 and 17 may be set arbitrarily or at random.

Figure 9:
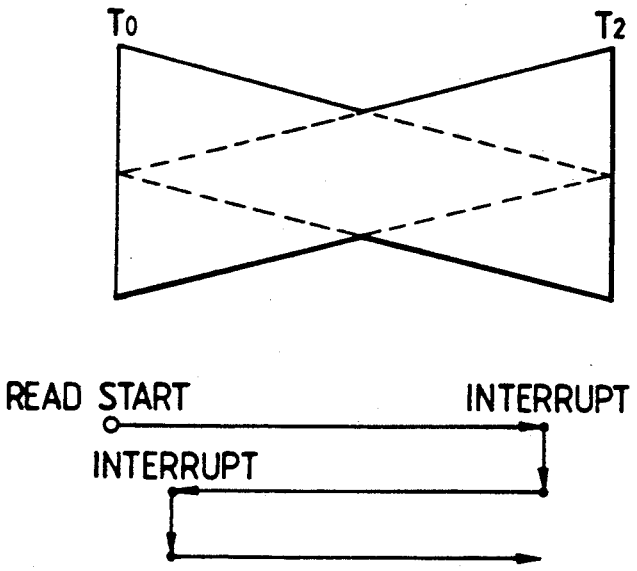
FIG. 9 shows another method of reading of the waveform shown in FIG. 5A-5F.

FIG. 9 illustrates another method of reading the waveform data shown in FIG. 5. That is, a reading of the waveform data stored in the second memory is started at a time instance T0 toward T2. However, at a time instance Tr before the reading reaches the time T2, the reading is interrupted and, then, restarted toward T0. Further, at a time instance Ts before the reading reaches the time T0, the reading is interrupted and, then, restarted toward T2. An amplitude of Ts may be the same as that of Tr.

When the waveform data is read out as shown in FIG. 5, a listener may get tired if the number of loopings is large. In the looping shown in FIG. 9, the listener may find it fresh.

Figure 10:
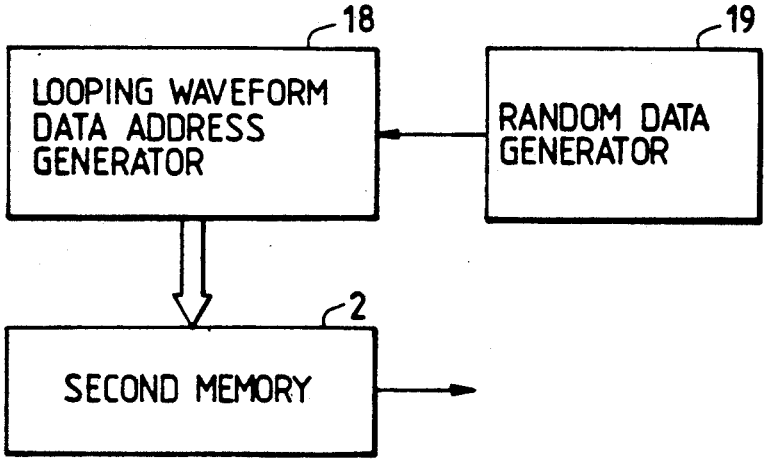
FIG. 10 is a block diagram for performing the method shown in FIG. 9.

FIG. 10 shows a block circuit diagram for performing the looping system shown in FIG. 9. In FIG. 10, reference numerals 18 and 19 depict a looping data waveform address generator circuit and a random data generating portion, respectively. The random data generating portion 19 generates random data and a reverse address shown in FIG. 9 is obtained in the address generator circuit, according to which the second memory device 2 is accessed. With the construction shown in FIG. 10, it becomes possible to set the time instances Tr and Ts at which the reading direction is reversed may be set arbitrarily or at random for every reading.

As described, according to the present invention, there is no difference in data value between a start of looping and an end thereof and, therefore, there is no noise produced thereby.

What is claimed is:

1. A waveform data looping system, comprising:

first memory means for storing waveform data obtained by sampling a waveform for a predetermined time period, said waveform data being read out from a start point to an end point within said predetermined time period repeatedly.

processing means for dividing said data stored in said first memory means into first and second sections at an intermedial point of said predetermined time period, multiplying said first section with a coefficient varying from 0% at said start point to 100% at said intermedial point, multiplying said second section with a coefficient varying from 100% at said intermedial point to 0% at said end point and adding resultant multiplied waveform data to produce an overlap-ed waveform data signal, second memory means for storing an output data of said processing means, and reproduction means for reading out said data stored in said second memory repeatedly and reproducing said data from said start point to said intermedial point repeatedly.

2. A waveform data looping system, comprising:

first memory means for storing in a location thereof waveform data obtained by sampling a waveform for a predetermined time period, said waveform data being read-out from a start point to an end point within said predetermined time period repeatedly, processing means for multiplying said data stored in said first memory means with a coefficient varying from 100% at said start point to 0% at said end point, the resultant multiplied data being stored temporarily in another location of said first memory means, and processing simultaneously said temporary waveform data at a start point read out from said first memory means and said temporary waveform data at an end point read out from said first memory means to produce an overlapped waveform data signal, second memory means for storing read out from said start point to an intermedial point of said produced overlapped waveform data signal and from said intermedial point back to said start point sequentially; and reproduction means for reading out said data stored in said second memory repeatedly and reproducing said data from said start point to said intermedial point repeatedly.

3. A waveform data looping system comprising:

first memory means for storing in a first location thereof waveform data obtained by sampling a waveform for a predetermined time period, said waveform data being read out from a start point to an end point within said predetermined time period repeatedly, processing means for multiplying said waveform data stored in said first memory means with a coefficient varying from 100% at said start point to 0% at said end point to obtain a first data, said first data being stored temporarily in a second location of said first memory means, multiplying said waveform data with a coefficient varying from 0% at said start point to 100% at said end point to obtain a second data, said second data being stored in a third location of said first memory means, and reading out said first and said second data from said second and said third locations of said first memory means, second memory means for storing second waveform data representing first data read out from said start point to an intermedial point of said predetermined time period at which data values of said first data and said second data become equal and second data read out from said intermedial point back to said start point sequentially, and reproduction means for reading out said second waveform data stored in said second memory repeatedly and reproducing said second waveform data from said start point to said intermedial point repeatedly.

4. The waveform data looping system as claimed in any of claim 1 to 3, further comprising envelope waveform generator means and multiplying means for multiplying an output of said envelope waveform generator means and an output of said second memory means, whereby an input data to said reproduction means having an envelope is reproduced repeatedly.

5. The waveform data looping system as claimed in any of claims 1 to 3, further comprising control means for externally instructing and controlling a start and an end of reading of said data stored in said second memory means.

6. The waveform data looping system as claimed in claims 1 to 3, wherein said coefficient varying from 0% at said start point to 100% at said intermedial point varies from 0% to 100% at one of monotonically and at a varying rate.

7. The waveform data looping system as claimed in any of claims 1 to 3, wherein a plurality of looping data are prepared and reproduced sequentially while each said looping data is reproduced a predetermined number of times.

8. The waveform data looping system as claimed in claim 7, wherein the sequence of reproduction of said plurality of said looping data prepared is set at one of arbitrarily and at random.

9. The waveform data looping system as claimed in claim 7, wherein the number of loopings for said plurality of said prepared looping data is set at one of arbitrarily and at random.

10. A waveform data looping system comprising:

first memory means for storing in a first location thereof waveform data obtained by sampling a waveform for a predetermined time period, said waveform data being read out from a start point to an end point within said predetermined time period repeatedly, processing means for multiplying said waveform data stored in said first memory means with a coefficient varying from 100% at said start point to 0% at said end point to obtain a first data, said first data being stored temporarily in a second location of said first memory means, multiplying said waveform data with a coefficient varying from 0% at said start point to 100% at said end point to obtain a second data, said second data being stored in a third location of said first memory means, and reading out said first and said second data from said second and said third locations of said first memory means, second memory means for storing second waveform data representing first data read out from said start point to an intermedial point of said predetermined time period at which data values of said first data and said second data become equal and second data read out from said intermedial point back to said start point sequentially, and reproduction means for reading out said second waveform data stored in said second memory repeatedly and reproducing said second waveform data from said start point to said intermedial point repeatedly.

wherein, when said data stored in said second memory device is read out and reproduced, the reading is interrupted before the reading reaches said end point and restarted in the reverse direction and, then, the reading in the reverse direction is interrupted before it reaches said start point and restarted in said one direction.

11. The waveform data looping system as claimed in claim 10, wherein the point at which the reading direction is switched is set at one of arbitrarily and at random for every reading.

12. The waveform data looping system as claimed in claim 10, wherein said plurality of said prepared looping data are readout .

* * * * *